United States Patent [19]

Hoffman

[11] Patent Number: 4,646,043

[45] Date of Patent: Feb. 24, 1987

[54] SOLENOID HAVING A PLUNGER NON-FIXEDLY ADJOINING AN END OF THE ARMATURE

[75] Inventor: Jerzy Hoffman, Marina Del Rey, Calif.

[73] Assignee: Wavecom, Northridge, Calif.

[21] Appl. No.: 716,677

[22] Filed: Mar. 27, 1985

[51] Int. Cl.[4] ..... H01K 7/08

[52] U.S. Cl. ..... 335/255; 335/262; 335/265

[58] Field of Search ..... 335/251, 255, 258, 259, 335/262, 264, 265

[56] References Cited

U.S. PATENT DOCUMENTS

| | | | |
|---|---|---|---|
| 1,817,592 | 8/1931 | Sokoloff | 335/259 |
| 2,405,396 | 8/1946 | Bazley | 335/262 X |
| 3,713,059 | 1/1973 | Tada | 335/259 |
| 3,735,302 | 5/1973 | Eckert | 335/262 |

*Primary Examiner*—George Harris

*Attorney, Agent, or Firm*—Spensley Horn Jubas & Lubitz

[57] ABSTRACT

A solenoid is disclosed which uses a plastic coil bobbin as the bearing surface for the armature, the body of which extends coaxially through the central cylindrical cavity of the bobbin. Extending into this cavity, from the end opposite the armature, is a plug which is rigidly fixed to the bobbin by an outer housing that surrounds the bobbin and has a skirt which captures a flanged end of the plug. A plunger that extends through an axial bore in the plug floats freely, coaxially of the bobbin. The interior end of the plunger has an enlarged head that is received within a bore in the armature body. A bias spring is situated between this plunger head and a counterbore in the plug.

5 Claims, 1 Drawing Figure

SOLENOID HAVING A PLUNGER NON-FIXEDLY ADJOINING AN END OF THE ARMATURE

BACKGROUND OF THE INVENTION

1. Field of the Invention

The present invention relates to a solenoid of simplified construction.

2. Description of the Prior Art

In certain applications, such as microwave coaxial switches, it is necessary to provide multiple, small solenoids for moving mechanical components in response to electrical control signals. For example, a typical microwave switch may have a single coaxial input port and three, four, five or more output ports. A mechanical arrangement of movable leaf contacts is used to connect the input port alternatively to a selected one of the output ports.

In such a switch, to maintain the necessary impedance, insertion loss, isolation and VSWR characteristics, the movable leaf contacts must be situated in small, closely adjacent but isolated channels. Imparting the necessary mechanical movement to these leaf switches necessiates the use of multiple solenoids which are compact enough in size to fit closely within the small switch package, that typically has an overall height in the order of two to three inches, and an overall diameter of three inches or less.

Perhaps more important than small size, in such applications, is the necessity that each solenoid have positive, failure free operation through hundreds of thousands of operating cycles. Should one of the solenoids not function even intermittently, the entire switch assembly would have to be removed and disassembled for repair, an operation that is costly both in terms of repair time itself and in down time of the equipment in which the switch is located.

Thus there is a need for a positive acting solenoid, small in size, which by its construction has minimal likelihood of failure, and it is an objective of the present invention to provide such a solenoid.

One common failure mechanism of prior art solenoids resulted from the use of epoxy or other adhesives to hold the coil bobbin within the solenoid structure. Often residual films of the epoxy or other adhesive would accumulate on the armature bearing surface. Such buildup would lead to occasional binding of the armature, thereby preventing or impeding its normal movement. This resulted in intermittent operation of the associated microwave switch, since occasionally armature movement would be insufficient to move the switch leaf contact all the way between the "break" and "make" positions.

Thus another object of the present invention is to provide a solenoid which uses no adhesives in its assembly.

Another failure mode of prior art solenoids was wear or erosion of the bushings for the armature or solenoid shaft or plunger. Such mechanical wear could result in improper seating of the armature or plunger. As a result, the movement may deviate from the desired direction or distance, again causing intermittent operation of the microwave switch in which the solenoid is employed.

It is another object of the present invention to provide a solenoid in which there is very little wear and tear, and in which even if some wear of the bushing components should occur, positive operation of the solenoid would not be impaired.

SUMMARY OF THE INVENTION

These and other objectives are achieved by providing a solenoid in which a plastic coil bobbin acts as the bushing for the armature. The armature itself imparts movement to a floating plunger which extends through a plug that is captured in one end of the bobbin. A bias spring, situated between the plug and a cap at the end of the plunger adjoining the armature, provides the return force for both the plunger and armature. The solenoid is assembled without the use of adhesives, and wear on the bearing surfaces of the bobbin or plug bore will not distort true operation of the solenoid.

DESCRIPTION OF THE PREFERRED EMBODIMENT

Figure 1:
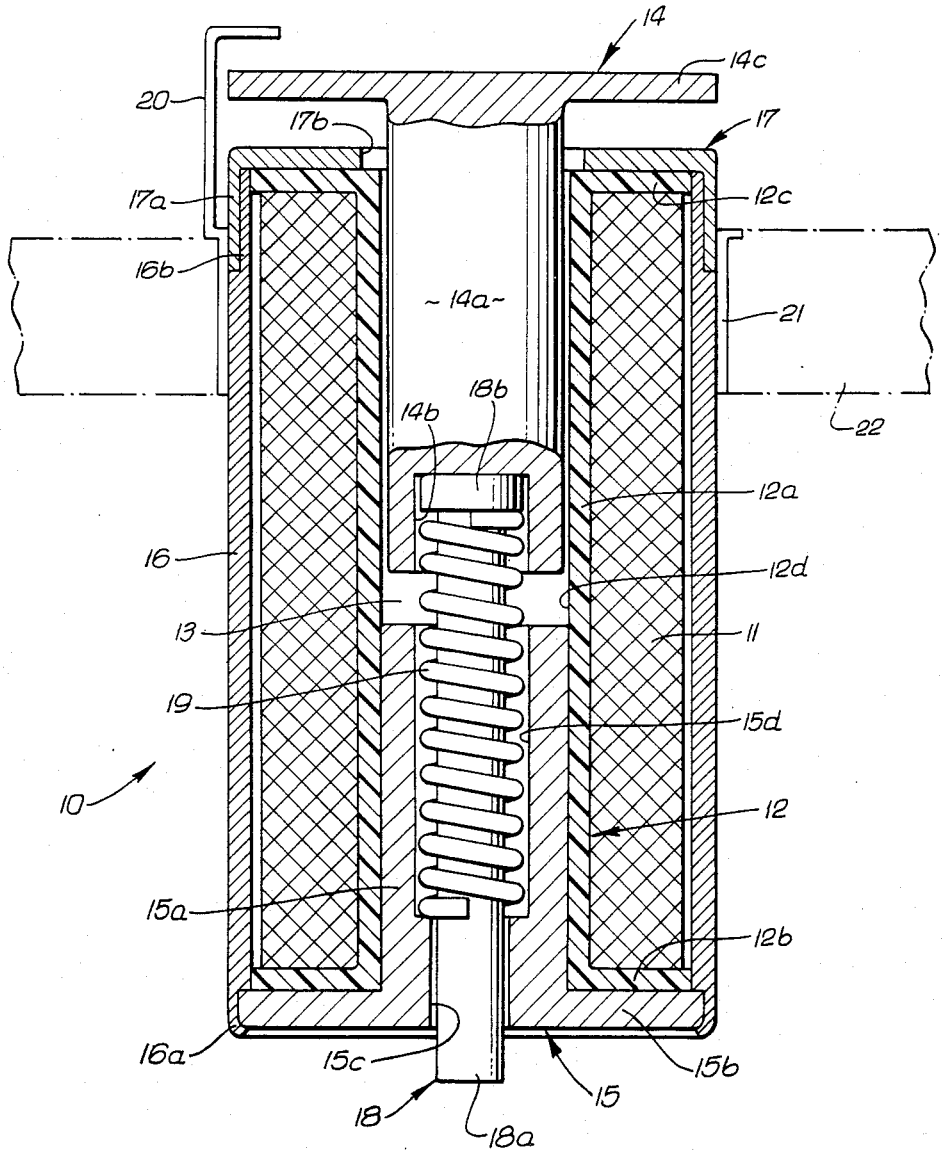
FIG. 1 is a transverse sectional view of a preferred embodiment of the inventive solenoid.

The following description is of the best presently contemplated mode of carrying out the invention. This description is not to be taken in a limiting sense, but is made merely for the purpose of illustrating the general principles of the invention, since the scope of the invention best is defined by the appended claims.

As shown in FIG. 1, the invention solenoid 10 uses a coil 11 wound within a high temperature resistant plastic bobbin 12. The bobbin 12 is formed of a cylinder 12*a* and unitary annular ends 12*b* and 12*c*.

The cylindrical interior surface 12*d* of the bobbin 12 defines an interior cavity 13 within which extends a cylindrical body 14*a* of an armature 14. The armature 14 is made of a material such as Leadloy or Armco-5 which is attracted by the magnetic field of the coil 11.

The bobbin interior surface 12*d* serves as the bearing for the armature body 14*a*. Advantageously, the diameter of the body 14*a* is between 0.003 and 0.004 inches smaller than the inside diameter of the bobbin 12. The body 14*a* may be nickel plated to further reduce the already low friction between the plastic bobbin 12 and the body 14*a*. As described below, no adhesives are used in the assembly of the solenoid 10 so that there is no adhesive film on the interior bobbin surface 12*d* which might impede the smooth movement of the armature 14.

Also extending into the cavity 13, from the end opposite the armature 14, is a plug 15. This plug 15 has a cylindrical body 15*a* that is press fit within the cavity 13, and has an annular end flange 15*b* which abuts against the end 12*b* of the bobbin 12. Surrounding this bobbin 12 is a cylindrical metal housing 16 having a skirt 16*a* that is rolled around the plug flange 15*b* so as to capture the plug 15 and maintain it in a rigid, fixed relationship to the bobbin 12. The other end of the housing 16 is enclosed by an annular cap 17 which abuts against the bobbin end 12*c* and includes a skirt portion 17*a* that engages the end 16*b* of the housing 16. A press fit is sufficient, since during operation of the solenoid 10 there is no force tending to remove the cap 17. The cap 17 has a central clearance opening 17*b* through which extends the armature body 14*a*.

A free-floating plunger 18 is situated coaxially within the cavity 13 and includes an end 18*a* that projects outwardly of the plug 15. The plunger 18 extends through a bore 15*c* in the plug 15 which functions as a loose fit bushing for the plunger. The other end 18*b* of the plunger has an enlarged unitary cap 18*b* which seats freely in a cylindrical recess 14*b* formed in the armature body 14*a*. A coil spring 19 surrounds the plunger 18 and at one end extends into the recess 14*b*. The other end of the spring 19 extends into a counterbore 15*d* in the plug 15. Accordingly, the spring 19 biases the plunger 18 and the armature 14 in the direction which retracts the plunger end 18*a* and which urges the outwardly extending annular end 14*c* of the armature away from the end 12*c* of the bobbin 12. An optional bracket 20 limits movement of the armature 14 in this direction.

When coil 11 is energized (via electrical leads not shown in FIG. 1), the resultant magnetic field attracts the armature 14 toward the bobbin 12, thereby pushing the plunger 18 outwardly of the solenoid 10. The spacing between the lower end of the armature body 14*a* and the uppper end of the plug body 15*a*, and the distance between the armature flange 14*c* and the housing cap 17 advantageously are selected to be longer than the distance which the plunger end 18*a* must travel to ensure positive operation of the mechanical component being moved by the solenoid 10. That will avoid any possible problem resulting from the armature movement being stopped by the plug 15 before the plunger 18 has completely moved the associated mechanism through the desired distance.

Since the plunger 18 is freely floating, and is not ridigly attached to the armature 14, a slight variation in the direction of movement of the armature 14 would not affect proper movement of the plunger 18. Thus, for example, if the interior bearing surface 12*d* of the bobbin 12 should become worn more on one side than the other of the armature body 14*a*, it is conceivable that the movement of the armature 14 would not be exactly coaxial with the bobbin 12. But even in this instance, the plunger 18 would travel normally in its intended direction and through its intended distance so as to positively actuate the associated mechanism.

Furthermore, it will be seen that no adhesive is required in the assembly of the solenoid 10. The rolled end 16*a* of the housing 16 firmly captures the plug 15 and the bobbin end 12*b*. This firm mechanical capture, combined with the press fit of the plug body 15*a* within the bobbin cylinder 12*a*, prevents any tendency for the solenoid 10 to become disassembled under the force of the armature 14 when moved by the magnetic field of the coil 11. Since there is little force urging the bobbin 12 toward the cap 17, no adhesive is required to join the bobbin 12, housing 16 and cap 17 at the armature end of the solenoid. Since the use of adhesive in the assembly of the solenoid 10 thus is completely eliminated, there is no problem of adhesive film buildup on the interior bearing surface 12*d*. This eliminates one failure mode associated with prior art solenoids.

The effect of wear on the plug bore 15*c*, which acts as a bearing surface for the plunger 18, likewise is minimal. Such wear will not effect the stroke distance of the plunger 18, which is established by the movement of the armature 14 and the permitted movement of the mechanism operated by the solenoid 10.

In a typical embodiment, the solenoid 10 may have a diameter of 0.3 to 0.4 inches and a length of about 0.3 to 0.9 inches. The solenoid may be mounted by means of an optional bracket 21, or may be captured within the structure 22 of a larger device, such as a coaxial microwave switch, of which the solenoid is a component. A bore may be provided in the top of the armature 14 to reduce the mass thereof. Such bore may also receive the shaft of an indicator mechanism that would mechanically indicate whether or not the solenoid 10 is energized.

Heat expansion of the coil 11 will not adversely affect operation of the solenoid 10. Any such expansion will have little or no effect on the relative position of the armature 14 or the extent of movement of the plunger 18.

The bobbin 11 which is used is made from high-temperature plastic because of economics. However, the bobbin can be made from different materials, such as brass.

I claim:

1. A solenoid comprising:

a coil wound about a plastic bobbin, said bobbin having a cylindrical interior cavity, a magnetically attracted armature extending moveably into one end of said cavity, the plastic surface of said bobbin cavity serving as the bushing for said armature, a plug fixedly held within the other end of said cavity, a plunger moveably extending through an axial bore in said plug, one end of said plunger non-fixedly adjoining the end of said armature within said cavity, the other end of said plunger extending outwardly of said plug, and bias means within said cavity for biasing said plunger and said armature in a direction opposite the direction of movement magnetically imparted to said armature by said coil.

2. A solenoid comprising:

a plastic bobbin having a cylinder and annular ends extending radially outwardly from each end of said cylinder, a coil wound about said bobbin cylinder between said ends, a plug having a cylindrical body and an annular flange extending outwardly from one end of said cylindrical body, said plug body being situated within said bobbin cylinder with said flange abutting one end of said bobbin, said plug having an axial bore extending therethrough from said one end and an axial counterbore extending from the end opposite end of said plug, there being an internal shoulder within said plug where said bore and counterbore meet, a cylindrical housing surrounding said bobbin and coil, one end of said housing being rolled over the outer periphery of said plug flange, a plunger moveably extending through said counterbore and bore of said plug, one end of said plunger being situated interiorly of said bobbin cylinder and having a cap, the other end of said plunger extending axially exteriorly of said plug, a bias spring surrounding a portion of said plunger and extending between said plug internal shoulder and said plunger cap, and an armature having a cylindrical body extending into the other end of said bobbin interior cavity and being freely axially moveable with respect to said bobbin, with the interior surface of said bobbin interior cavity serving as the bushing for said armature, said armature having an annular end flange extending from one end of said armature body to a diameter generally conforming with the outer diameter of said bobbin, said armature being formed of a material having magnetic attractability, there being an axial counterbore in the end of said armature body extending within said cavity to receive the cap end of said plunger non fixedly within said counterbore, said spring biasing said plunger toward said armature, energization of said coil causing said armature to move axially within said cavity toward said plug and to push said plunger outwardly of said plug and solenoid, and upon termination of said energization, said bias spring biasing said plunger and hence said armature in the opposite direction.

3. A solenoid according to claim 2 wherein the surface of said armature body within said bobbin cylindrical cavity is nickel plated, wherein there is a cap at the end of said housing opposite said plug, and wherein said solenoid is assembled without adhesive.

4. A solenoid according to claim 1 wherein said bobbin is brass or other non-magnetic material instead of plastic.

5. A solenoid according to claim 1 wherein the outwardly extending other end of said plunger is adapted for force transmitting communication with an object to be actuated by said solenoid.

* * * * *